United States Patent [19]

Stocker

[11] 3,965,644

[45] June 29, 1976

[54] APPARATUS AND METHOD FOR MAIL PREPARATION

[75] Inventor: Lester H. Stocker, Phillipsburg, N.J.

[73] Assignee: Bell & Howell Company, Phillipsburg, N.J.

[22] Filed: Oct. 31, 1975

[21] Appl. No.: 627,742

[52] U.S. Cl. ..... 53/29; 53/35; 53/266 A; 270/58

[51] Int. Cl.[2] ..... B65B 43/30

[58] Field of Search ..... 53/31, 35, 266 A, 206, 53/386, 187, 29; 270/58; 93/35 PC, 61 R, 61 A

[56] References Cited

UNITED STATES PATENTS

| | | | |
|---|---|---|---|
| 3,260,517 | 7/1966 | Sather | 270/58 |
| 3,271,022 | 9/1966 | Sather et al. | 270/58 |
| 3,869,964 | 3/1975 | Kranz | 53/206 X |

*Primary Examiner*—Travis S. McGehee
*Assistant Examiner*—Horace M. Culver
*Attorney, Agent, or Firm*—Griffin, Branigan and Butler

[57] ABSTRACT

An inserting machine of the type having an insert raceway, insert stations along the raceway, and an envelope-stuffing station at the end of the raceway, further includes a pocket stuffing station for stuffing a card or the like into a pocket formed on an insert sheet. The pocket on the insert sheet is open along one edge thereof which is directed toward the side of the conveyor from which the card will be stuffed into the pocket. The insert sheet includes a portion which extends beyond the insert pocket and this portion is on the bottom when the insert sheet is on the raceway. When the insert sheet is at the pocket stuffing station a suction mechanism lifts the upper side of the pocket while a guide holds the portion extending beyond the insert pocket down, thereby spreading the pocket's open edge. Pusher fingers then push the card into the pocket.

8 Claims, 6 Drawing Figures

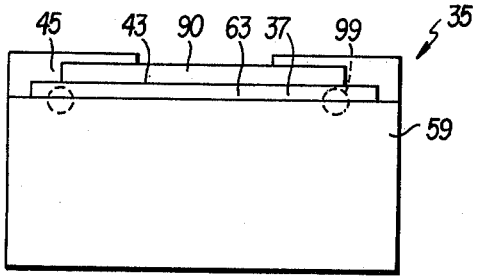
FIG. 4
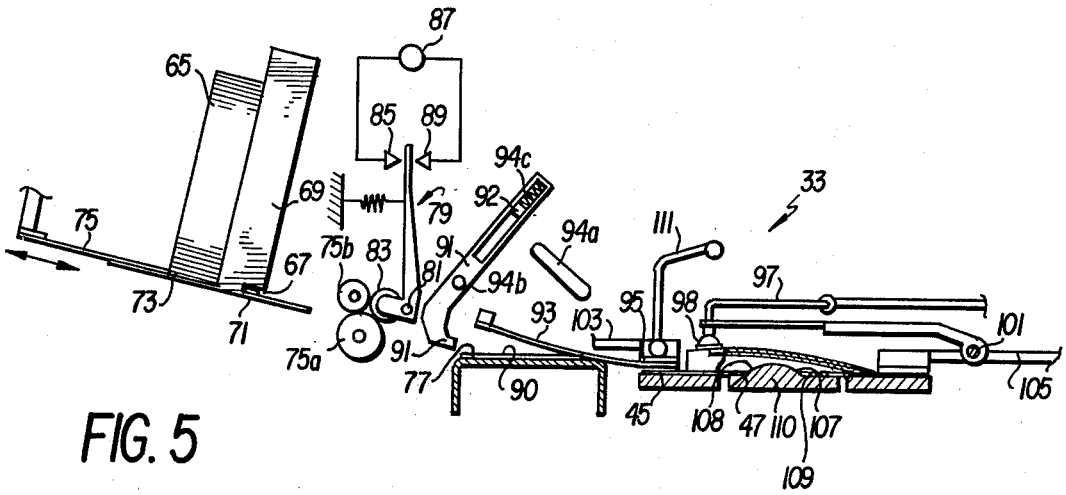
FIG. 5
FIG. 6
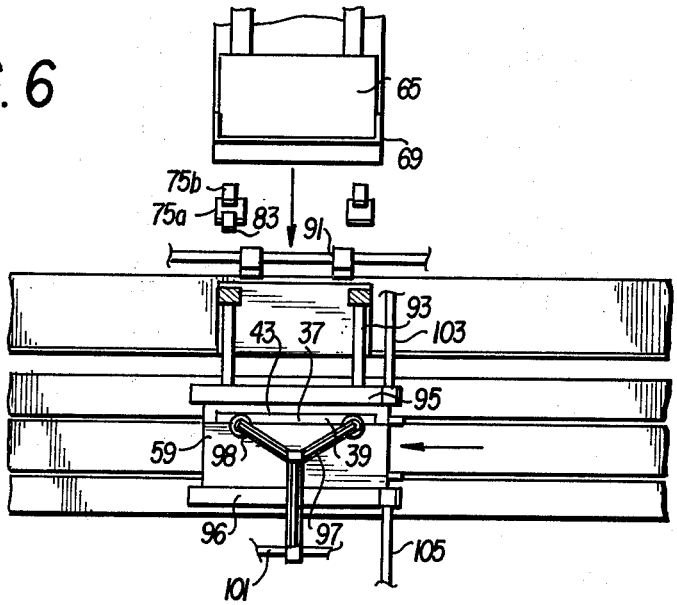

APPARATUS AND METHOD FOR MAIL PREPARATION

BACKGROUND OF THE INVENTION

This invention relates broadly to the art of mail-preparation machinery, and more specifically to machinery for assembling various letters and inserts and stuffing them into envelopes.

Many businesses, such as insurance companies, send out large mailings of various advertising materials with which they include response cards for receivers to respond with. It has been found that some arrangements of the advertising materials and response cards generate higher percentages of responses than other arrangements. In this respect, one arrangement which produces a relatively high percentage of response is a single letter sheet having a pocket formed on the back thereof with a return postcard positioned therein. The letter has a cut-out opening therein through which the address of the sending company on the card can be seen. It is intended that a receiver reads the short letter and responds thereto by simply pulling the card out of the pocket, filling in his address thereon, and mailing it.

Although such an arrangement of mailing material is known to be effective, there are problems in preparing such an arrangement. In many cases, the cards are inserted into the letters pockets by hand in order to avoid these problems. One of the problems is that when the card is inserted into the pocket, it often catches on an edge of the cut-out opening. Thus, it is an object of this invention to provide apparatus for inserting a card into a pocket formed on a letter sheet which avoids catching the card on an edge of a cut-out opening in the letter sheet.

Another problem is that when the letter is folded the folded portions thereof make it difficult to open the pocket for inserting a card. Thus, it is an object of this invention to provide a letter/pocket arrangement and a machine for inserting cards into the pockets which produces reliable opening of the pockets for insertion of the cards.

Normally, in the prior art, the pockets formed on letter sheets are open at the sides thereof and cards are, therefore, inserted therein from the sides. However, it has proven to be very difficult to develop machinery for inserting the cards into the pockets under this arrangement. Thus, it is also an object of this invention to provide a letter/pocket arrangement and a card insertion method which can be easily adapted to automation.

In addition to "hand inserting" cards, however, some specialized machines for inserting cards into pockets of letters are used; however, the letters still must thereafter be processed by an envelope inserting machine for inserting the letters into envelopes. Thus, it is yet another object of this invention to provide a machine which completely prepares letter/pocket mailings in one continuous process.

It is yet another object of this invention to provide an uncomplicated, and relatively inexpensive-to-manufacture method and apparatus for preparing letter-pocket mailings.

SUMMARY OF THE INVENTION

According to principles of this invention, a letter-pocket stuffing station is added to a prior art "gripper-jaw type" envelope inserting machine. In this regard, a pocket is formed on an insert sheet, the pocket being open along a top edge thereof. A portion of the insert sheet extends beyond the pocket at the open edge. The insert sheet is placed on an inserter-machine raceway, including a conveyor, with the portion of the insert sheet extending beyond the pocket being on the bottom and the open edge of the pocket being oriented toward a stuffing side of the conveyor. The conveyor conveys the insert sheet to a pocket stuffing station at which the upper side of the pocket is lifted while the portion of the insert sheet extending beyond the open edge of the pocket is held down, thereby spreading the open edge of the pocket into a receiving configuration. A card is stuffed into the spread pocket from the stuffing side of the conveyor. The insert sheet is then conveyed with the stuffed card in the pocket thereof to an envelope stuffing station where it is shoved from the conveyor into an open envelope.

BRIEF DESCRIPTION OF THE DRAWINGS

The foregoing and other objects, features, and advantages of the invention will be apparent from the following more particular description of the preferred embodiments of the invention, as illustrated in the accompanying drawings in which reference characters refer to the same parts throughout the different views. The drawings are not necessarily to scale, emphasis instead being placed on illustrating principles of the invention in a clear manner.

FIG. 4 is a back view of the insert sheet and card of FIGS. 2 and 3 when the insert sheet is folded;

FIG. 5 is a sectional view taken on plane 5—5 of FIG. 1; and

FIG. 6 is a top view of the pocket stuffing station of FIG. 5 and FIG. 1.

DESCRIPTION OF THE PREFERRED EMBODIMENT

Figure 1:
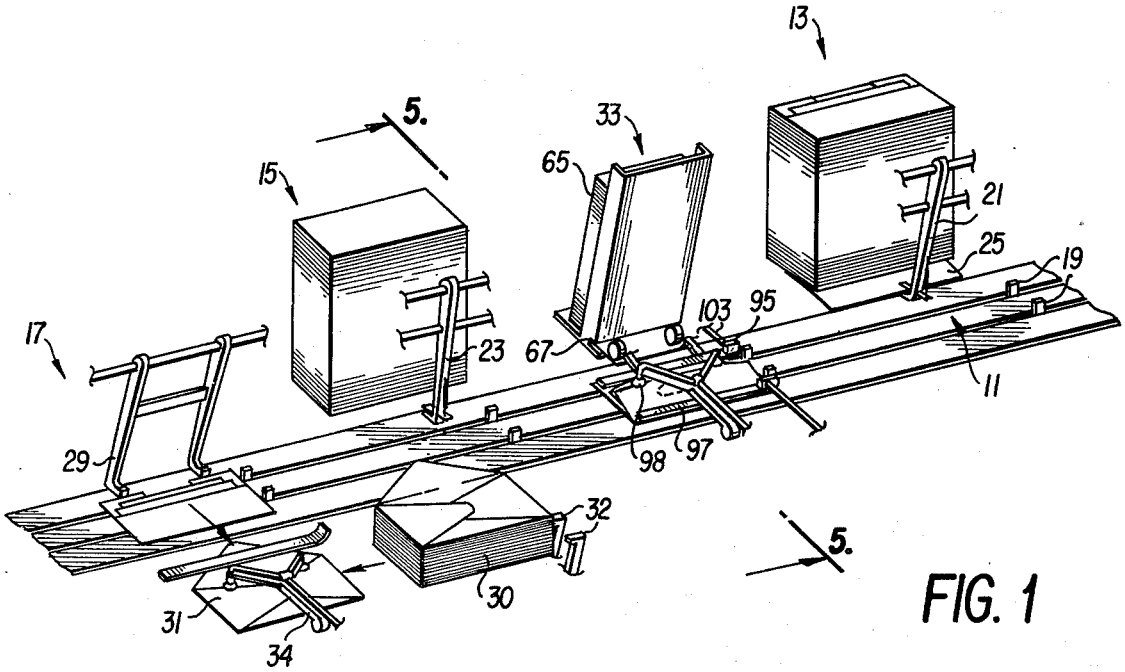
FIG. 1 is an isometric drawing of a simplified gripper-jaw type envelope inserting machine having a pocket-stuffing station according to principles of this invention with parts removed for the sake of clarity.

A gripper-jaw type inserting machine includes basically a raceway, or conveyor 11, (FIG. 1) inserting stations 13 and 15, and an envelope stuffing station 17. The well known operation of conventional inserting machines of this type is that a letter sheet to be mailed is pushed along the raceway 11 by chain-mounted pins 19 in a intermittent manner from station to station. As a letter comes in front of each of the inserting stations 13 or 15, a reciprocating gripper-jaw 21 or 23 grips a bottom-most insert 25 from an insert stack 27, pulls it over the raceway 11 and releases it to drop on top of the letter sheet. When such a letter/insert set arrives at the envelope stuffing station 17, pusher fingers 29 drive the set into a waiting open envelope 31. The envelope 31 is fed from an envelope stack 30 by feed fingers 32, and held open by a suction pivot arm 34. This apparatus is described in numerous patents, such as U.S. Pat. No. 3,260,517 to Sather, and it is not thought necessary to describe it in greater detail here.

Figure 2:
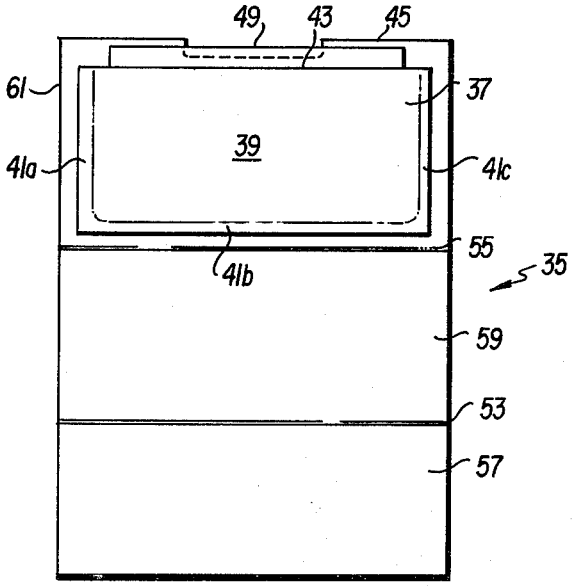
FIG. 2 is a back view of an insert sheet having a pocket with a card therein in accordance with principles of this invention.
Figure 3:
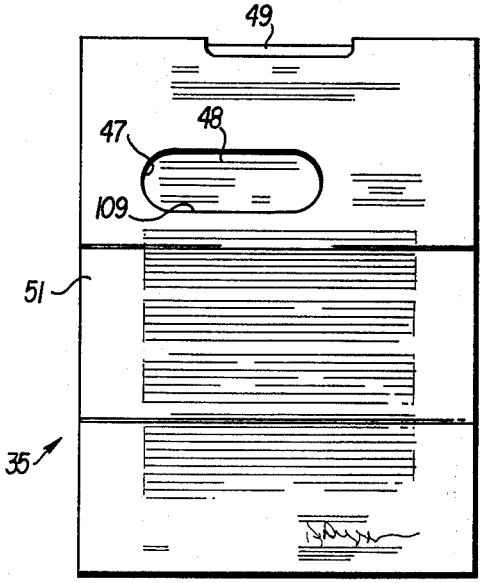
FIG. 3 is a front view of the insert sheet and card of FIG. 2.

This invention contemplates the addition to the above described system of an insert-pocket stuffing station 33 and the use of a particular pocket-bearing insert sheet or letter 35 (See FIGS. 2–4).

The pocket-bearing insert letter 35 has a pocket 37 formed on the back thereof by gluing a separate sheet of paper 39 along three edges 41*a*, *b*, and *c* thereof while leaving an open edge 43 which is directed toward a top portion 45 of the insert letter 35. The insert letter 35 has an opening 47 therein through which written material 48, (FIG. 3) such as an address, on a card 49 in the pocket 37 can be seen from the front 51 of the letter 35.

The insert letter 35 is designed to be folded toward the back thereof along creased lines 53 and 55 to the configuration depicted in FIG. 4. It should be noted that the lowest portion 57 and the middle portion 59 of the insert letter 35 are approximately the same size, but are narrower than the uppermost portion 61. Thus, when the lowest and middle portions 57 and 59 are folded onto the pocket 37, they do not cover a top portion 63 (FIG. 4) of the pocket 37 at the open edge 43.

It should also be noted, that the top portion 45 of the insert letter 35 extends beyond the open edge 43 of the pocket 37.

The equipment at the pocket-stuffing station 33 includes a magazine for holding a stack of cards 65 which defines a throat 67 between upper and lower members 69 and 71. A lowermost card 73 is fed from the stack of cards 65 by a reciprocating pusher 75 which pushes the lower-most card 73 through the throat 67, returns to let the next higher card fall in front of it, and then repeats the cycle.

Drive rolls 75*a* and *b* grip thusly fed cards and drop them onto a slightly raised surface 77. During this step, the cards are checked for "doubles" or "misses" by a roller/arm sensor 79 which pivots about an axis 81. In this respect, when there is a "miss" (and no card is fed) a sensor roller 83 is urged against the lower drive roll 75*a* and its arm contacts an electrical terminal 85. Such contact is sensed by a monitoring device 87. Conversely, when there is a double (and more than one card is fed) the sensor roller 83 is urged away from the lower drive roll 75a by the cards and its arm contacts a terminal 89 which is sensed by the monitoring device 87 as a double. In either case, the monitoring device 87 shuts down the whole system and provides an alarm, although it would not have to be designed to operate in this way.

Once a card 90 is on the slightly-raised surface 77, pusher fingers 91 are reciprocated over it backwardly by a square shaft 92, or the like, and engage its trailing edge. The pusher fingers 91, driven by the square shaft 92, then drive the card under flexible entering fingers 93 toward the raceway 11. In this regard, the pusher fingers are forwardly driven along the raised surface 77 and backwardly above the raised surface due to cooperation between an angled stationary cam 94*a*, a cam follower 94*b* attached to the pusher fingers 91 and a spring 94*c*, the cam follower 94*b* passes under the cam 94*a* on the forward movement and over the cam 94*a* on the rearward movement.

The entering fingers 93 extend under a flexible flap-hold down guide 95 which is positioned on top of the top portion 45 of a folded pocket-bearing insert letter 35 at the pocket-stuffing station 33.

Since the slightly raised surface 77 is above the top portion 45 of the insert letter 35, the card 90 passes over the top portion 45 but is held against the upper surface of the top portion 45 by the flap hold down guide 95. A reciprocating, pivoted, suction element 97, having suction cups 98, grips the pocket 37 and the folded portions 57 and 59 of the insert letter 35 at the areas indicated by dotted circles 99 in FIG. 4 and as can be seen in FIG. 6. The suction element 97 pivots upwardly about an axis 101 to lift the separate sheet 39 forming the pocket 37 and the folded portions 57 and 59 to spread the open edge 43 of the pocket 37 to receive the card 90 urged toward it by the pusher fingers 91. In this respect, two edges of the insert letter 35 are held down while the pocket 37 is spread by the flap hold down guide 95 and a complementary bottom guide 96. These two guides are flexible and are attached to a stationary frame at points 103 and 105.

A raised frog, or support 107, having angled edges 108 is positioned on a stationary surface 110 in the raceway 11 at the pocket-stuffing station 33. The frog 107 extends into the openings 47 of insert letters 35 when they are at the pocket-stuffing station 33. The frog 107 guides cards 90 over the lower edge 109 of the openings 47 to prevent jamming of cards 90 thereagainst.

With regard to jamming, a jamming detector 111 is positioned on top of the flap hold-down guide 95 to detect abnormal vertical movement of the flap hold-down guide 95. Such movement is indicative of a jam.

In operation of the mail preparation apparatus of this invention, folded pocket-bearing insert letters 35 are sequentially fed in front of pins 19 on the raceway 11 at the inserting station 13 by a gripper-jaw 21. The folded insert letters are layed on the raceway with the pockets 37 thereof facing a stuffing side of the raceway 11.

After they are on the raceway 11, each of the pocket-bearing insert letters is indexed one position to the left, as viewed in FIG. 1, by the drive pins 19 to the pocket-stuffing station 33. At the pocket-stuffing station 33, the suction cups 98 grip the pocket 37 and the reciprocating, pivoted suction element 97 lifts it upwardly. The top portion 45 of the insert letter 35 is held down by the flap hold-down guide 95 to spread the open edge 43 of the pocket 37. A card is then driven into the pocket 37 by the pusher fingers 91 under the entering fingers 93 and flap hold-down guide 95. The pocket 37 is then released by the suction cups 98 and the drive pins 19 are indexed to drive the insert letter 35, having a card in its pocket, further along the raceway 11. Additional inserts can be dropped on the insert letter 35 as desired from additional inserting stations such as the inserting station 15.

In any case, however, the insert letter 35 eventually arrives at the envelope stuffing station 17 where it is pushed from the raceway 11 by pusher fingers 29 directly into an open envelope 31.

It is not thought necessary to describe the various linkages that synchronize operations of the different elements of this invention as such linkages are well known in the prior art and a description thereof would confuse the main features of this invention. Further, many of the systems described herein which are well known in the prior art are not described in great detail for the purposes of simplicity.

Although the invention has been described with reference to a particular embodiment, it will be understood by those skilled in the art that various changes in form and detail may be made therein without departing from the spirit and scope of the invention. For example, the square shaft 92 can be replaced by two spaced shafts -- one having lateral movement. The square shaft 92 is presented as being illustrative only of the required linkage.

The embodiments of the invention in which an exclusive property or privilege are claimed are defined as follows:

1. An inserting machine for supplying insert sheets having pockets formed thereon, stuffing cards into said pockets and stuffing said insert sheets with cards in the pockets thereof into respective envelopes, said inserting machine comprising:

an insert raceway including a conveyor for receiving said insert sheets having pockets formed thereon at an insert-sheet supply station and intermittently conveying said insert sheets first to a pocket-stuffing station and then to an envelope stuffing station;

an insert-sheet supply means positioned at said insert-sheet supply station adjacent to said conveyor for sequentially placing individual insert sheets having pockets formed thereon on said conveyor;

an insert card stuffing means positioned at said pocket-stuffing station adjacent to said conveyor downstream of said insert-sheet supply station for engaging the pockets formed on insert sheets stopped at said pocket-stuffing station, opening said pockets, and inserting a card into each of said pockets;

an envelope stuffing means positioned at said envelope stuffing station adjacent to said conveyor downstream of said pocket-stuffing station for supplying empty, open envelopes and stuffing each of said insert sheets with cards in the pockets thereof into an open envelope.

2. An inserting machine as in claim 1 wherein said conveyor conveys along a straight path and said insert sheet supply means comprises a magazine for holding a stack of insert sheets and a pivoted, reciprocating gripper-jaw sequentially pulling the lower-most insert sheet from the insert sheet stack and placing it on said conveyor and wherein said insert card stuffing means includes pusher fingers for driving said cards into said pockets.

3. An inserting machine as in claim 2 wherein said insert card stuffing means includes a flap hold-down guide for holding down back portions of said pockets, a suction means for picking up top portions of said pockets, and entering-finger guides for guiding cards under the flap hold-down guide into said pockets.

4. An inserting machine as in claim 1 wherein said insert card stuffing means includes a flap hold-down guide for holding down back portions of said pockets, a suction means for picking up top portions of said pockets, and entering-finger guides for guiding cards under the flap hold-down guide into said pockets.

5. A method of preparing mailings including the steps of:

forming an insert pocket on an insert sheet, said insert pocket being open along one edge thereof;

placing said insert sheet on a conveyor and conveying said insert sheets therewith to a pocket-stuffing station, said open edge of said pocket being oriented toward a stuffing side of said conveyor;

at said pocket stuffing station, lifting the upper side of said pocket while holding the lower side of said pocket down, thereby spreading the open edge of said pocket in a receiving configuration, and stuffing a card into said spread pocket from said stuffing side of said conveyor; and conveying said insert sheet with said card stuffed in the pocket thereof with said conveyor to an envelope stuffing station and thereat shoving said insert sheet directly from said conveyor into an open envelope.

6. A method of preparing mailings as in claim 5 wherein a portion of said insert sheet extends beyond the insert pocket at said open edge and wherein the portion of said insert sheet extending beyond said insert pocket is placed on the bottom on the conveyor; and wherein the portion of said insert sheet extended beyond said insert pocket is held down when the upper side of said pocket is lifted.

7. A method of preparing mailings as in claim 6 wherein said insert sheet is placed on said conveyor with a reciprocating gripper-jaw and wherein said insert sheet is conveyed with said conveyor along a straight path.

8. A method of preparing mailings as in claim 5 wherein said insert sheet is placed on said conveyor with a reciprocating gripper-jaw and wherein said insert sheet is conveyed with said conveyor along a straight path.

* * * * *